United States Patent [19]

Wardlaw, III

[11] Patent Number: 4,585,158

[45] Date of Patent: Apr. 29, 1986

[54] METHOD OF WELDING USING PREHEATING INSERT FOR HEAVY WALL PIPE

[76] Inventor: Louis J. Wardlaw, III, 15306 Bonita Springs, Houston, Tex. 77083

[21] Appl. No.: 674,257

[22] Filed: Nov. 23, 1984

Related U.S. Application Data

[60] Division of Ser. No. 366,555, Apr. 8, 1982, Pat. No. 4,507,082, which is a continuation-in-part of Ser. No. 236,999, Feb. 23, 1981, abandoned.

[51] Int. Cl.[4] ..... B23K 23/00

[52] U.S. Cl. ..... 228/232; 228/241

[58] Field of Search ..... 228/232, 241; 432/225, 432/226, 224, 10, 63; 126/271.2 R; 166/58, 59, 61; 266/167

[56] References Cited

U.S. PATENT DOCUMENTS

| | | | |
|---|---|---|---|
| 896,070 | 8/1908 | Williams | 432/224 |
| 1,544,015 | 6/1925 | Lamy | 432/224 |
| 2,286,075 | 6/1942 | Evans | 166/58 |
| 2,569,956 | 10/1951 | Schiltknecht | 228/241 |
| 2,650,539 | 9/1953 | Greene | 166/58 |
| 4,001,152 | 1/1977 | Leonhardt | 126/263 |

FOREIGN PATENT DOCUMENTS

| | | | |
|---|---|---|---|
| 2326660 | 6/1977 | France | 228/232 |
| 1427632 | 3/1976 | United Kingdom | 228/241 |

OTHER PUBLICATIONS

J. C. McCaig, Bonding and Joining Technology, *Exothermic Brazing Units,* U.S.G.P.O. 1974, p. 12.

*Primary Examiner*—Nicholas P. Godici
*Assistant Examiner*—Carmine Cuda
*Attorney, Agent, or Firm*—Gunn, Lee & Jackson

[57] ABSTRACT

A method of welding using a preheating insert is disclosed. The method includes the steps of positioning and igniting a combustible solid fuel mixture within a pipe to preheat the pipe by convection to a proper temperature and welding the pipe. The preferred and illustrated embodiment incorporates an encircling bottom support having a centralized hollow tube. It is made of a frangible material to be easily broken should it fall into the pipe. It supports a hollow, cylindrical, combustible heating element. The heating element is made of thermite as an example. It includes a top located deflector plate to deflect hot gases flowing upwardly from combustion against the wall of a pipe to be heated. The apparatus is concentrically located within the pipe in the vicinity of the pipe section to be heated.

4 Claims, 2 Drawing Figures

METHOD OF WELDING USING PREHEATING INSERT FOR HEAVY WALL PIPE

RELATED APPLICATIONS

This application is a divisional application of U.S. Ser. No. 366,555, U.S. Pat. No. 4,507,082 filed Apr. 8, 1982, which is a continuation-in-part application of U.S. Ser. No. 236,999, filed on Feb. 23, 1981, now abandoned.

BACKGROUND OF THE DISCLOSURE

In drilling an oil well, especially at an offshore location, it is necessary to install flanges of various sizes of large diameter pipe. Consider, as an example, the instance where several sizes of casing are installed in a well. The well might include, as an example, a 36 inch drive pipe. There may also be a 20 inch casing, 13⅜ths inch casing and 9⅝ths inch casing. It is necessary to install a termination flange or casing head at every change of size. The flange is typically installed by first cutting the casing, preheating the casing and then welding the flange in place. The flange is necessary to mount other equipment or to otherwise isntall the next casing string.

Often, this requires cutting a very thick wall casing, even in the range of 1½ inch thick and thereafter making a multi-pass welded bead to attach the flange. This requires a tremendous amount of preheating to obtain a quality weld.

For drilling rigs located at sea, the preheating is something of a problem. In inclement weather, wind shields must be installed and a number of welders will position their torches on the casing and flange to preheat it for perhaps 4 to 6 inches below the casing head in length to perhaps 500° F. This is difficult and time consuming. Moreover, cooling begins on the instant that preheating is stopped. It is difficult to preheat the casing and simultaneously weld a flange to it.

Certain devices have been provided heretofore to serve as preheaters. While these devices have various and sundry advantages, it is believed that the device of this disclosure is much more attractive for the intended purpose, namely to provide a preheater which can be selectively installed within a casing, whereby preheating occurs from the interior. This enables the welder to install the flnage or casing head and quickly begin the multi-pass bead required to fasten the flange in place.

The various preheater devices are typified by the patent of Jaeger, U.S. Pat. No. 3,082,760. However, this device and others like it are believed to be limited. There is a real risk that the preheater device will be lost down the casing. If this occurs, it may then be lost in the wellbore. In the wellbore, it poses a serious problem. It is necessary to remove it because it is very difficult to drill through the steel Jaeger device. In either case it is not very desirable.

The preheater device of this disclosure utilizes a cement receptable which is non-corrosive to saltwater, relatively inexpensive, and able to be broken into small pieces should it fall into the wellbore. It is relatively easy to drill through the cement device. This does not impede the drilling process that occurs subsequently to the use of the preheater device.

The present disclosure is therefore directed to a preheater device which is formed of a cement body of frangible material. This includes a bottom cylindrical receptacle. It terminates at the center in an upstanding stalk with light weight chain pre-cast through the length of the body. The cement body is self-centralizing and supports an elongate cast cylindrical exothermic compound. One suitable material is molded thermite. A deflector plate made of the same cement is positioned on the top. It is sized relative to the casing to direct the flow of hot gases outwardly and against the wall of the casing to be heated. The device is held in place by a chain attached to one of the utility hoist cables common to all drilling rigs.

BRIEF DESCRIPTION OF THE DRAWINGS

So that the manner in which the above recited features, advantages and objects of the invention, as well as others, which will become apparent, are attained and can be understood in detail, a more particular description of the invention, briefly summarized above, may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admmit to other equally effective embodiments.

DETAILED DESCRIPTION OF THE PREFERRED EMBODIMENT

Figure 1:
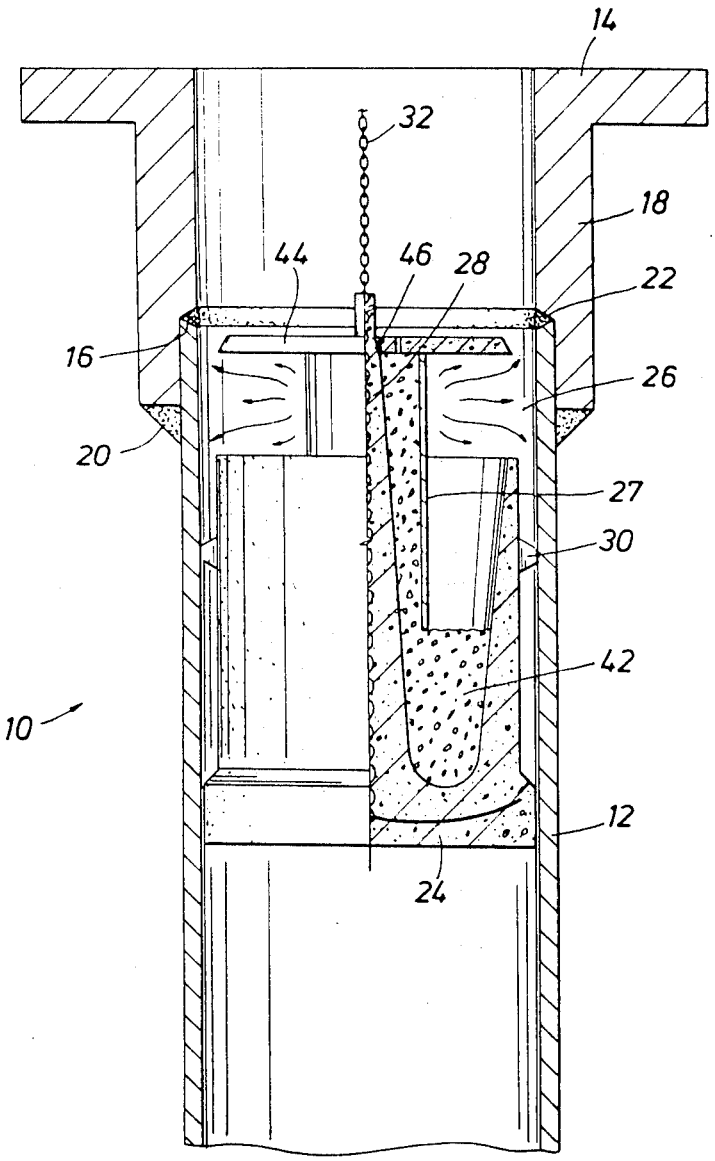
FIG. 1 is a partial sectional view through the preheater device of the present disclosure positioned in a casing to heat the casing and flange for welding.

Attention is first directed to the single view which discloses the apparatus of the present disclosure. It is identified generally by the numeral 10. It is shown in a pipe 12. Assume, for purposes of illustration, that the pipe 12 is a large casing having a wall thickness conforming with industry standards. The pipe 12 can range from ½ inch thick to about 1½ inches or greater. Moreover, a flange 14 is to be attached to the pipe 12. The flange 14 is constructed with an internal shoulder 16 to abut the end of the pipe 12. It has a cylindrical portion 18 which telescopes over the pipe. A multi-pass bead is formed at 20, and an inside or finish bead is formed at 22. The bead 20 must be formed first to fully and completely anchor the flange to the pipe 12. The weld 20 is a high quality weld, subject to 100% inspection, and must be formed in many passes.

It is very important to preheat the pipe to a specified temperature. Failure to evenly preheat the pipe may damage the weld 20. It is for this purpose that the present preheater is installed in the pipe 12. Moreover, it is spaced so that the rising hot gases in the pipe are deflected against the pipe in the near vicinity of the weld 20 to preheat that area to the required temperature. Since it requires a substantial period of time to weld the flange in place, the preheater of this disclosure must burn for a significant interval. This is a scale factor which can be varied dependent on the size of the pipe, the temperature required in preheating, the number of passes required in the weld 20 and other factors such as these. Suffice it to say, the present disclosure provides a preheater which can be sized to preheat the pipe to the required temperature for the required interval. To this end, the device 10 is shown in the pipe 12, being located in the position that it maintains during use.

The preheater device 10 includes cement bottom support member 24. This is constructed in the form of a cylinder with centralizing projections. The member 24 is fabricated of heat resistant calcium aluminate cement with expanded vermiculite as grog, and should be capable of supporting the combustible element during its combustion, as for instance, at temperatures upwards of 5,000° F. The support member 24 is of sufficient thickness to retain the white hot slag from the exothermic reaction. Ideally, it is quite frangible and can be easily fractured on drilling through it later in the process should it all fall into the wellbore. There is an air gap 26 at the top of the cylinder to direct hot gases at the casing wall 12.

A smaller diameter cellulose tube 27 fits over the neck 28 of the device and is filled with moulded thermite. This is to support the neck during shipment and to facilitate ignition by means of touch holes in the upper deflector plate. Ideally, the neck 28 is cast as a single piece with the bottom support member 24.

The preheater 10 is centralized within the pipe 12 by several integrally cast protrusions 30. A light weight chain 32 is cast into the device as a means of suspension in the wellbore. It will be recalled that the preheater is partly combusted and, therefore, loses weight during combustion. It is preferable that the chain 32 be sufficiently strong even when heated that it retains its strength to suspend the illustrated shape.

The numeral 44 identifies a top deflector plate. The deflector plate is supported on an inclined circumferential shoulder 46 formed on the neck 28 of the device 10. The angle of the shoulder 46 need not be extreme, and is typically in the range of 45 to 60 degrees. The deflector plate 44 is provided with a matching counter-sunk shoulder for cooperative engagement with the shoulder 46. The deflector 44 terminates at an outer edge which is sized to fit within the casing 12 with perhaps ¼ to ½ inch of clearance. During combustion, rising hot gases flow upwardly through the gap 26, and flow past the edge of the deflector 44. This deflects the hot gases towards the wall and thereby heats the pipe 12 in the most desirable manner. This particularly assists in directing the heat against the casing 12 in the near vicinity of the welded bead 20 on the exterior. The device is positioned so that the edge of the deflector is close to the bead 20 so that the hot gases are deflected against it.

The fuel 42 is a sacrificial, poured mixture made of non-toxic materials. One example is exothermic thermite which is defined, for purposes of this diclosure, as a granulated and cast mixture of aluminum particles with iron oxide. A bonding agent is added and suitable bonding agents include various and sundry binders such as starch. The fuel 42 is sacrificial in that it must be a combustible material which sustains a slow burn for the requisite interval. For instance, the fuel may be poured with suitable ihibitors and binding agents so that it burns at 5,000° F. for sufficient time to heat the casing by convection and subsequently the wellhead by conduction. It will be appreciated that it shrinks during combustion. As it shrinks, it nevertheless gives off great clouds of heated gases which rise towards the deflector 44 and pass through the gap 26 adjacent to the preheater. This preheats the pipe to the required temperature for the required interval. Various and sundry inhibitors can be added to slow down the rate of burning. For added strength, chopped nylon fibers can be mixed in random fashion within the slurry which forms the fuel 42.

For ease of starting the fire, the top portions of the fuel compound 42 may be poured with some oxygen liberating compound. It should be a compound which liberates substantial quantities of oxygen and ideally is a metal salt which does not create toxic fumes. One example is potassium perchlorate. This can be mixed into the fuel compound in portions ranging from 0% to a fairly heavy concentration. The oxygen liberating compound can be evenly mixed or biased at the top to start the fire readily. This makes the device start burning much easier.

Various and sundry starters are known and can be adhesively joined to the top of the fuel compound 42. Alternatively, it can be started in combustion by simply playing an acetylene torch on the top portions of the fuel in the touch-holes in the deflector plate. Once combustion has begun the device is lowered on an overhead suspension apparatus (not shown) into the casing 12 and combustion is permitted to continue until the fuel is entirely consumed.

As an example of one fuel compound, a suitable starch, serving as a binder, is mixed with approximately equal parts by volume of aluminum and iron oxide. They are preferably ground relatively fine, having particles in the range of about 20 mesh or smaller. Other sizes can be used, it being kept in mind that larger particles burn slower and at a lower temperature. The top one-third of the compound is formed with a suitable perchlorate mixed in the slurry before pouring, the concentration ranging up to about 10% by weight.

The device of the present invention is particularly easy to use. It is positioned in the casing 12 and suspended so that the deflecting plate 44 is exposed. A welder ignites fuel in the touch-holes with his torch and the preheater is then lowered into the casing until it is positioned as shown. Various and sundry temperature sensitive devices are used on the exterior to determine that the casing has been adequately preheated. When this occurs, the welder can then begin welding the flange in position by forming the multi-pass bead 20. On large casing, the bead 20 is formed by many passes. After the several passes are made, the bead can thereafter be inspected on permitting the casing to cool. It is also optionally necessary to form the bead 22 on the interior of the casing. This bead is formed typically after the preheater 10 has been removed from the casing. This bead is less critical in terms of preheating.

The present apparatus can be sized by varying the amount of exothermic compound placed into the cement casting. For a given combustible mixture such as thermite, the dimensions can be varied to control the duration of burning.

The integrally cast projections which extend from the bottom and upper third of the casting 24 radiate outwardly to position the preheater 10 in the casing. They do not have to be precise in length or location. Precise alignment of the bottom end of the equipment is less important than positioning concentrically in the casing of the deflector 44. As a general proposition, the spacing of the deflector plate should be relatively concentric with respect to the pipe 12. As will be understood, a chimney effect may occur which sweeps the heated gases upwardly against the casing. This carries excess heat out through the top and away from the welder so that his field of vision is not obscured.

Figure 2:
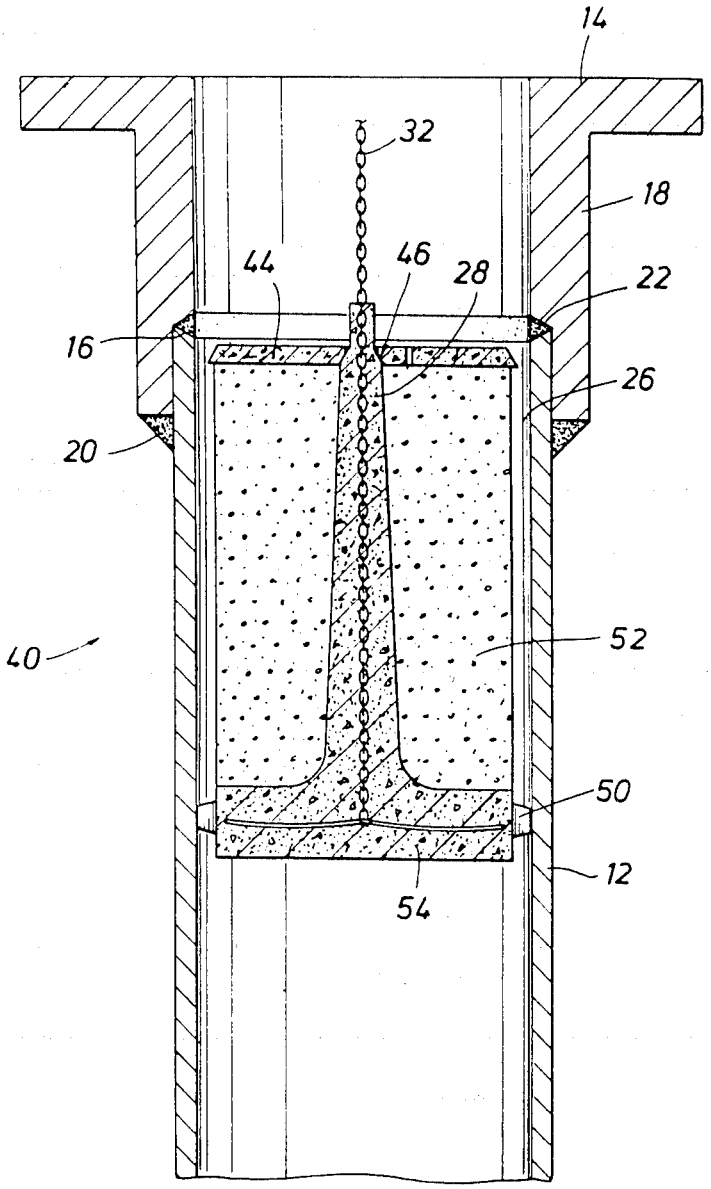
FIG. 2 is a sectional view of an alternate embodiment of the invention.

Referring now to FIG. 2, an alternate embodiment of the invention is shown. It will be observed that the apparatus 40 differs from the apparatus of FIG. 1 in that it is not constructed in the form of a cylinder open at the top and closed at the bottom. The apparatus 40 includes a base member 54 extending radially outwardly from the lower end of the neck 28. Preferably, the neck 28 and the base member 54 are cast as a single piece. Integrally cast projections 50 are equally spaced about the periphery of the base member 54 for centralizing the apparatus 40 within the pipe 12.

The fuel mixture 52, in the alternate embodiment, is molted thermite, a slow burning, non-toxic material previously described herein. The fuel mixture 52 is a cast cylindrical body having an axial opening extending therethrough for receiving the stem 28. It is supported at the lower end thereof by the base 54. The deflector plate 44 caps the fuel mixture 52 as shown in FIG. 2. The cylindrical body of the fuel mixture 52 is sized to fit within the pipe 12 with perhaps one half to one inch of clearance about the periphery thereof. During combustion, hot gases radiate outwardly from the cylindrical body of the fuel mixture 52 to thereby heat the wall of the pipe 12. The hot gases rise upwardly and flow past the edge of the deflector plate 44. The fuel mixture 52 is positioned so that it is opposite the bead 20, as shown in FIG. 2, so that hot gases are deflected against it. As the fuel mixture 52 burns, the white hot slag from the exothermic reaction falls to the bottom of the wellbore and it is drilled through later in the process.

While the foregoing is directed to the preferred embodiment of the present invention, other and further embodiments of the inventon may be devised without departing from the basic concept thereof, and the scope thereof is determined by the claims which follow.

I claim:

1. The method of welding a pipe by preheating a pipe section thereof, comprising the steps of:

(a) igniting a combustible solid fuel mixture supported within the pipe;

(b) positioning the solid fuel mixture within the pipe opposite the pipe section where a weld bead is to be formed;

(c) heating the pipe section by convection to an elevated temperature by directing heated gases given off by the ignited fuel mixture against the pipe section;

(d) monitoring the temperature of the pipe section to determine that the pipe section has been heated to a specified temperature; and (e) welding the pipe by forming a multi-pass bead.

2. The method of claim 1 wherein the solid fuel mixture is supported in a cylindrical casting sized to fit within the pipe.

3. The method of claim 2 wherein the heated gases are directed against the pipe section by a deflector plate positioned above and spaced from said cylindrical casting defining a gap therebetween, said deflector plate extending outwardly and arranged concentrically within the pipe to deflect the heated gases radially toward the surrounding pipe section.

4. The method of claim 1 wherein the solid fuel mixture comprises a molded cylindrical body supported on a base member suspended within the pipe.

* * * * *